US009669288B2

(12) United States Patent
Pertgen

(10) Patent No.: US 9,669,288 B2
(45) Date of Patent: Jun. 6, 2017

(54) METHOD, APPARATUS, CLUSTERED DEVICES, AND COMPUTER READABLE STORAGE FOR CONDUCTING A WAGERING GAME

(71) Applicant: AGS, LLC, Las Vegas, NV (US)

(72) Inventor: Michael Pertgen, Las Vegas, NV (US)

(73) Assignee: AGS, LLC, Las Vegas, NV (US)

( * ) Notice: Subject to any disclaimer, the term of this patent is extended or adjusted under 35 U.S.C. 154(b) by 225 days.

(21) Appl. No.: 14/546,814

(22) Filed: Nov. 18, 2014

(65) Prior Publication Data

US 2016/0136512 A1 May 19, 2016

(51) Int. Cl.

| | |
|---|---|
| ***A63F 1/00*** | (2006.01) |
| ***G07F 17/32*** | (2006.01) |
| ***A63F 3/00*** | (2006.01) |
| *A63F 9/24* | (2006.01) |

(52) U.S. Cl.

CPC ..... *A63F 1/00* (2013.01); *A63F 3/00157* (2013.01); *G07F 17/3204* (2013.01); *G07F 17/3223* (2013.01); *G07F 17/3293* (2013.01); *A63F 2001/005* (2013.01); *A63F 2009/2491* (2013.01)

(58) Field of Classification Search

USPC ..... 463/11–13, 17, 46; 273/292

See application file for complete search history.

(56) References Cited

U.S. PATENT DOCUMENTS

| | | | | |
|---|---|---|---|---|
| 4,836,553 | A | 6/1989 | Suttle et al. | |
| 5,417,430 | A | 5/1995 | Breeding | |
| 5,685,774 | A | 11/1997 | Webb | |
| 5,813,673 | A | 9/1998 | Richardson | |
| 6,203,018 | B1 | 3/2001 | Osuch | |
| 6,237,916 | B1 | 5/2001 | Webb | |
| 6,299,532 | B1 | 10/2001 | Smith | |
| 7,000,921 | B2 | 2/2006 | Schultz | |
| 7,364,161 | B2 | 4/2008 | Lo | |
| 7,387,300 | B2 | 6/2008 | Snow | |
| 7,641,197 | B2 | 1/2010 | Jackson | |
| 8,096,556 | B2 | 1/2012 | Chamberlain | |
| 8,651,932 | B1 * | 2/2014 | Pertgen | G07F 17/326 273/292 |
| 8,752,839 | B2 | 6/2014 | Payne | |
| 9,202,343 | B1 * | 12/2015 | Pertgen | G07F 17/326 |
| 2004/0041346 | A1 * | 3/2004 | Snow | A63F 1/00 273/292 |

(Continued)

OTHER PUBLICATIONS

Scarne, John. "Scarne's Encyclopedia of Games," Jun. 1973, 14 pages.

*Primary Examiner* — Ronald Laneau
(74) *Attorney, Agent, or Firm* — Weide & Miller, Ltd.

(57) ABSTRACT

A method and device for conducting a wagering game includes receiving an ante wager. A player hand of game pieces is dealt and a final player hand is formed by selecting as many sets as possible of game pieces with complementary game indicia from the player hand. For example, the object of the game may be to form as many straights as possible from the player hand. The final player hand is evaluated by comparing the final player hand to a standard, such as a pay table, a final dealer hand, and/or final player hands of other players. Payouts are issued if the final player hand is a winning hand based on the evaluation. Optionally, side wagers may be offered on the constitution of the final player hand.

11 Claims, 4 Drawing Sheets

(56) References Cited

U.S. PATENT DOCUMENTS

| | | | | |
|---|---|---|---|---|
| 2005/0127606 | A1 | 6/2005 | Snow | |
| 2008/0252013 | A1 | 10/2008 | Tang | |
| 2011/0163501 | A1 | 7/2011 | Nguyen | |
| 2013/0157752 | A1* | 6/2013 | Yoseloff | G07F 17/3244 463/25 |
| 2016/0063812 | A1* | 3/2016 | Nizgoda | G07F 17/3244 463/25 |
| 2016/0140808 | A1* | 5/2016 | Scott | A63F 1/00 463/11 |

* cited by examiner

METHOD, APPARATUS, CLUSTERED DEVICES, AND COMPUTER READABLE STORAGE FOR CONDUCTING A WAGERING GAME

BACKGROUND

The present invention relates to wagering games. More specifically, the present invention includes a method, apparatus, clustered devices, and computer readable storage for conducting a wagering game in which a player forms a hand of varying size based on the complementary game pieces held by the player.

A number of theories exist as to the origin of the game of poker. It is said by some authorities that Poker originates from the ancient Persian game of As-nas. The modern form of poker with its innumerable, different forms can be traced to the European game of Primero which was played with four cards per person and the cards were ranked in a complicated points system. In England, Primero was overtaken in popularity by a game called Brag of which there were many forms: three-card, five-card, seven-card and nine-card versions, the most popular being the three-card stud version. Wild cards were often used in Brag and were known as Braggers.

In modern casinos the game of poker takes one of three forms: live or card room poker where players compete against one another and the House charges a levy either in the form of a participation fee or as a percentage of winning hands; electronic video machines offering various games of poker, in particular, five card draw poker; and poker played as a "banker's game" either where the game involves players in contest with the dealer's hand or where the object is for players to obtain a hand based on hierarchical poker rankings, or games which combine the above two objects.

Live or card room poker games commonly available include Texas Hold'Em, Omaha, and seven-card stud. These games require considerable skill and a relatively large bankroll to have any expectation of success. As a result, most novice players avoid card room games.

Casinos have attempted to address this concern by providing poker-style table games that are house-banked and that require little expertise. Typical examples of such games are Caribbean Stud™, U.S. Pat. No. 4,836,553 and Let It Ride™, U.S. Pat. No. 5,417,430. Both games are based on five-card stud. In Caribbean Stud™, for example, the players' hands are pitted against the dealer's hand. In Let It Ride™, the sole objective is to form a winning hand based on a set of odds and a hierarchy of poker hand rankings.

Another example of a house-banked poker game is Three Card Poker™, U.S. Pat. No. 6,237,916. In Three Card Poker™, each player may place an ante wager, a "pairs plus" wager, or both wagers. The ante wager is a bet on the player's hand against the dealer's hand and the "pairs plus" wager is a bet on the ranking of the player's hand against a schedule of winning hands. After examining his hand the player may fold and forfeit his ante wager or continue play by placing a mandatory play wager equal to the ante wager. This is often referred to as a "bet or fold" decision. To be rewarded on both the ante and play wagers two conditions must be met: (1) the dealer must have a qualifying hand of a Queen high or better and (2) the player's hand must outrank the dealer's hand. If the dealer hand does not qualify, the player wins an even money award on the ante wager and the play wager is returned. If the dealer hand qualifies and outranks the player hand, the player loses both the ante wager and the play wager. If the player has made the "pairs plus" wager and his hand includes a winning hand based on a schedule of winning hands, he receives a payout listed on the schedule.

SUMMARY

The present invention includes a method, apparatus, clustered devices, and computer-readable medium for conducting a wagering game. In one optional embodiment, a method may be conducted at a live table, electronic table, video gaming machine, kiosk, handheld device, cellular telephone, tablet, personal computer, or in any other fashion. In an optional embodiment conducted using a device, a device may include a data processor in communication with a display, a player interface, and a data storage device.

A method may be conducted using physical game pieces or electronic representations thereof. In one optional embodiment, the game pieces are playing cards. The game pieces are marked with at least one game indicium, the game indicia divided into at least two different groups. For example, in an optional embodiment in which the game pieces are playing cards, the playing cards may be marked with one of four different suits. In an optional embodiment conducted using a device, electronic representations of game pieces may be stored at a data storage device.

An ante wager is received from each player. In an additional or alternative embodiment, an optional side wager may also be received. In an optional embodiment in which a method is conducted using a device, the ante wager and optional side wager may be received through a player interface.

A player hand of game pieces is dealt for each player. In an optional embodiment implemented using a device, a player hand may be dealt by the data processor and displayed at a display. In one example, the player hand includes seven game pieces, e.g., seven playing cards.

In an optional embodiment, an election may be received from each player to place a raise wager to continue in the game or fold and forfeit the player's ante wager. In an optional embodiment, the maximum amount a player is permitted to bet as a raise wager varies depending on the player's player hand. For example, in one such optional embodiment, the maximum raise wager may increase as the quantity of cards in the player hand having complementary game indicia, e.g., matching suit, consecutive values, or the like, increase.

In an optional embodiment, a final player hand is formed from each remaining player hand by forming as many sets as possible of game pieces in the player hand marked with complementary game indicia. For example, in an optional embodiment in which the game pieces are playing cards marked with suits, each final player hand may consist of as many sets as possible of cards in the player hand of matching suit, i.e., multiple flushes. In another example, in an optional embodiment in which the game pieces are playing cards marked with values, each final player hand may consist of as many sets as possible of cards in the player hand with consecutive values, i.e., multiple straights. In an optional embodiment in which a method is conducted on a device, the data processor may form the final player hand and, optionally, display the final player hand at a display.

In one optional embodiment, a community hand of game pieces may be dealt. The community hand may be available to be combined with each player hand to form a final player hand. For example, a player hand may include two playing cards, a community hand may include five playing cards, and the player may form a final player hand from the seven playing cards available to the player.

Each final player hand is evaluated based at least on the quantity of sets in the final player hand and a determination is made whether to issue a payout based on the evaluation. For example, in an optional embodiment in which the game pieces are playing cards, a hand ranking system may be devised based on the quantity of sets in the final player hand with matching suit, i.e., multiple flushes, as well as the quantity of playing cards in the largest set, i.e., the largest flush. In another example, in an optional embodiment in which game pieces are playing cards, a hand ranking system may be devices based on the quantity of sets in the final player hand with consecutive values, i.e., multiple straights, as well as the quantity of playing cards in the largest set, i.e., the longest straight. In an optional embodiment in which a method is implemented on a device, a data processor may evaluate the final player hands and issue any pay outs based on the evaluation.

In an optional embodiment, the evaluation of the final player hands may include a comparison to determine if the final player hand is a winning hand. For example, in one optional embodiment, a dealer hand is dealt. A final dealer hand contains as many sets as possible containing game pieces, e.g., playing cards, with complementary game indicia, e.g., suit, value, or the like. The final player hands are evaluated by comparing each final player hand to the final dealer hand.

In an optional embodiment, the final dealer hand must have a qualifying ranking to proceed to the comparison step. If the final dealer hand fails to qualify, the comparison step may be omitted and the game terminated. For example, in one such optional embodiment, if the final dealer hand fails to qualify, the player may be paid on his or her ante wager and the player's raise wager may be returned. If the final dealer hand qualifies, but the final player hand outranks the final dealer hand by containing a greater quantity of sets, or by having the same quantity of sets, but having a set with a greater quantity of game pieces, the player may be paid on both the ante wager and raise wager. If the final dealer hand qualifies and outranks the final player hand, again by having a greater quantity of sets or by having the same quantity of sets but having a set with a greater quantity of game pieces, the ante wager and raise wager may be collected.

In another optional embodiment, the player hands may be evaluated by comparing each player hand to a pay table. In one such optional embodiment, a pay table may be defined with hand rankings and associated pay outs. The final player hands are compared to the hand rankings on the pay table and the pay out, if any, associated with the hand ranking of the final player hand is issued to the player. If the hand ranking of the final player hand does not appear on the pay table, the player's wager(s) may be collected.

In yet another optional embodiment, the player hands may be evaluated by comparing them to one another. For example, in one such optional embodiment, a hand ranking system may be defined, and the player having the highest ranking final player hand may be issued a payout. In the event of a tie, the tie may be resolved in any fashion.

In an optional embodiment, an optional side wager may be offered. In one such optional embodiment, a side wager pay table of hand rankings and associated pay outs is defined. A side wager is received prior to dealing the player hand. The side wager is resolved by comparing the final player hand to the side wager pay table and issuing the pay out, if any, associated with the final player hand. In one such optional embodiment, the pay outs may include a progressive pay out.

Further objects, features, and advantages of the present invention over the prior art will become apparent from the detailed description of the drawings which follows, when considered with the attached figures.

BRIEF DESCRIPTION OF THE EMBODIMENTS

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Reference is now made to the figures wherein like parts are referred to by like numerals throughout. The present invention is directed to a wagering game conducted using game pieces. The game pieces may take any form, including playing cards, tiles, dominoes, dice, or any other type of game piece. The game pieces are marked with at least one game indicium. The game indicia are divided into at least two groups.

For example, in one optional embodiment, the game pieces are playing cards. The playing cards may be conventional playing cards marked with a rank and a suit, with the ranks including deuce, three, four, five, six, seven, eight, nine, ten, Jack, Queen, King, and Ace and the suits including hearts, spades, diamonds, and clubs. Thus, in an embodiment of the game directed to using the suit game indicia, a conventional fifty-two card poker deck of playing cards are marked with one of four game indicia which identifies its membership within one of four suit groups.

Nevertheless, this should be interpreted as illustrative rather than limiting since a method according to the present invention may be conducted using a supplemented deck (a conventional poker deck including additional cards, such as Jokers), a truncated deck (a conventional poker deck excluding cards, such as a Spanish deck), or a modified deck (such as a poker deck with one or more conventional suits excluded, one or more additional suits added, one or more additional colors added, or the like) may be used. For example, a deck could include additional suits or exclude one or more conventional suits or provide different suits from those typically found on playing cards.

Similarly, the grouping of playing cards according to game indicia appearing on the playing cards may occur on a basis other than suits. For example, game indicia could include colors (conventional black or red or, alternatively, other non-conventional colors), numbers, letters, symbols, characters, animations, graphics, or any other perceptible indicia. Thus, the examples given below directed to flush hands based on suits should be interpreted as an illustration of a method according to the present invention rather than the entirety of the present invention.

Figure 1:
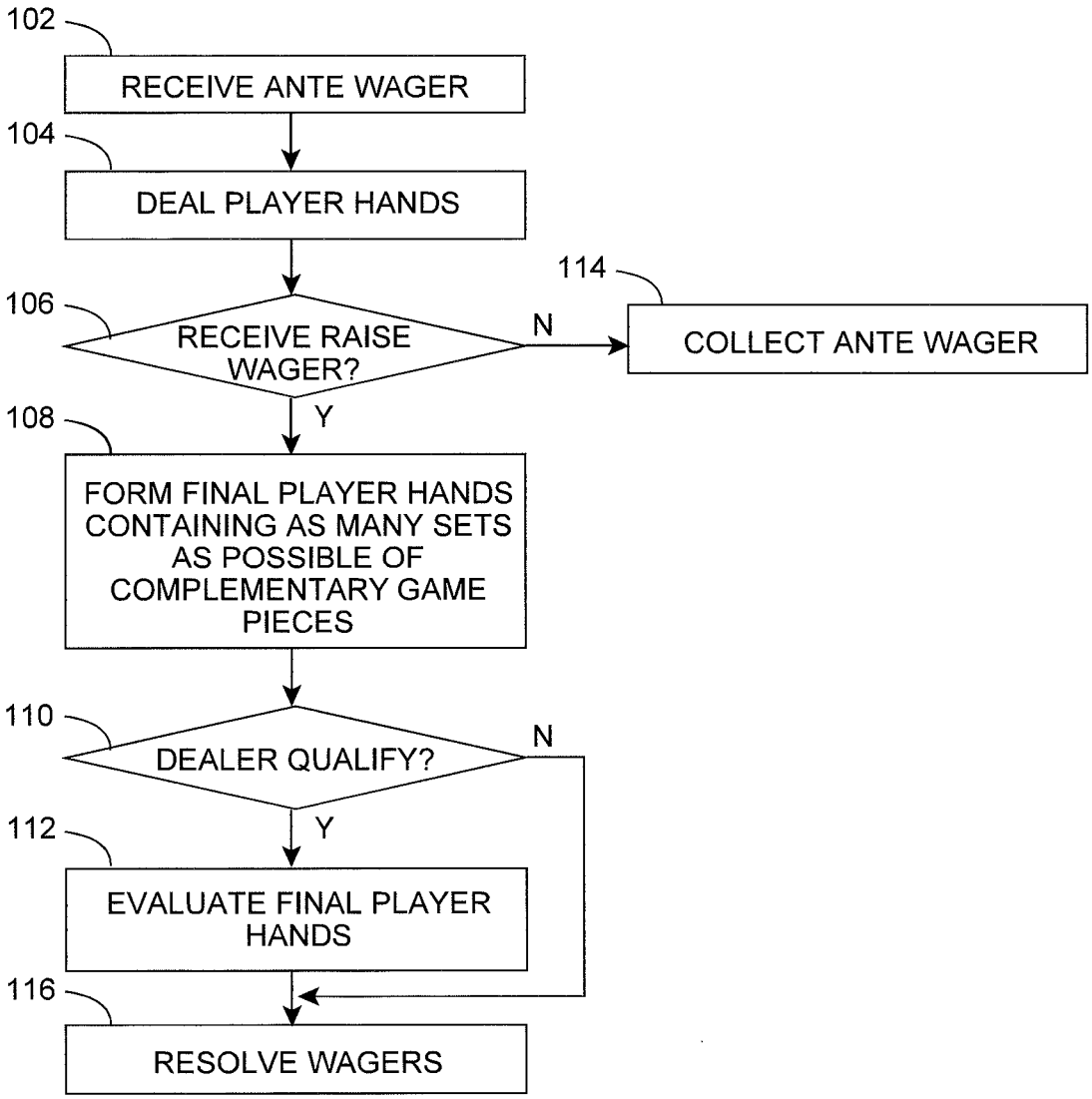
FIG. 1 is a flow chart of a method conducted according to an embodiment of the present invention.

In one embodiment illustrated in FIG. 1, an ante wager is received 102 from a player. In an optional embodiment, the ante wager is required for participation in the game. In an optional embodiment directed to a live table game, electronic table game, or the like, an ante wager may be placed using physical gaming chips, coins, currency, or the like. In an optional embodiment directed to an electronic device, the player may designate an ante wager using an input device or other player interface. The ante wager in an electronic game may be debited from a register of game credits stored by the electronic device.

In one optional embodiment, a player hand of game pieces is dealt 104 to each player who placed an ante wager. The quantity of game pieces making up a player hand may vary depending on the optional embodiment. For example, in an optional embodiment, a player hand of seven playing cards may be dealt to each player. The player hand may be dealt from a single deck of playing cards.

In one optional embodiment, the game may proceed to forming 108 final player hands and resolving 116 the ante wagers. In another optional embodiment, one or more rounds of wagering may occur after the player hands have been dealt but before final player hands are formed.

In one such example directed to a house-banked game, a decision may be received from each player to either place 106 a raise wager or fold and forfeit 114 the player's ante wager. This decision, sometimes referred to as a "bet-or-fold" decision, may be required from all players, i.e., every player in the game must either place a raise wager to continue in the game or fold and terminate his or her participation in the game. In an optional embodiment, the raise wager may be capped at a maximum amount. In a further optional embodiment, the maximum amount of the raise wager may be fixed or, alternatively, may vary depending on the player hand of the player placing the raise wager. Examples of how the maximum amount of the raise wager may vary are given below.

In another optional embodiment directed to a game played among players (optionally including a player-dealer), ante wagers may be aggregated in a pot. After player hands are dealt, players may conduct a round of wagering with players opting to bet or check or, after another player has already decided to bet, call, raise, or fold. For example, in one such optional embodiment, a player may be designated to open by betting or checking (passing without betting). Other players may, in turn, have the same decision until one player elects to bet. After the decision to bet is received, the other players may, in turn, elect to call (match the bet), raise (bet more than the initial bet), or fold (terminate play in the game and forfeit all prior bets). This may continue indefinitely or may be limited in some way, such as by limiting the number of raises and re-raises.

In yet other optional embodiments, no raise wagers may be available or, alternatively, raise wagers may be optional to the player, i.e., the player may, but is not required to, place a raise wager.

Each player forms 108 a final player hand based on the player hand. The final player hand is formed by forming as many sets as possible of game pieces with complementary game indicia in the player hand. The game pieces that are not part of a set of complementary game indicia may be removed from the final player hand, e.g., discarded or otherwise removed from the final player hand, or may remain in the final player hand. In an optional embodiment conducted using a device, the final player hand may be formed by the player using the player interface or may be formed automatically by the data processor.

Depending on the optional embodiment, a hand ranking system may be defined to form final player hands and determine whether a final player hand is a winning hand. For example, in an optional embodiment using conventional playing cards marked with suit indicia and value indicia, a hand ranking system may be based first on the quantity of sets of complementary playing cards and second on the quantity of playing cards in the largest set. More specifically, sets may include straights, i.e., playing cards of consecutive value.

In one such optional embodiment, the hand ranking system may first be based on the quantity of straights that can be formed from the playing cards of the player hand and second on the quantity of playing cards in the longest straight. Thus, in such an example, if a player hand consists of seven cards having the values Ace, 3, 4, 5, 5, 7, King, the final player hand would consist of two straights, i.e., the playing cards 3, 4, and 5 forming a three-card straight and the playing cards King and Ace forming a two card straight. Similarly, in such an example, if a player hand consisted of the playing cards with the values 2, 3, 3, 4, 7, 10, Jack, the final player hand would consist of three straights, i.e., the playing cards 2 and 3 forming a two-card straight, the playing cards 3 and 4 forming a two-card straight, and the playing cards 10 and Jack forming a two-card straight. Continuing with the example, the hand ranking system may be based first on the quantity of straights within the hand, then based on the longest straight within the hand. Thus, a hand containing three straights would outrank a hand with two straights, which, in turn, would outrank a hand with a single straight.

Where two hands have an equal number of straights, the hand with the longer straight would outrank the hand with the shorter straight. For example, a hand with three two-card straights would outrank a hand with a three-card straight and a two-card straight. Similarly, a three-card straight and a two-card straight would outrank a hand with two two-card straights. In such an optional embodiment, an optimum strategy would be to form as many straights as possible, including by breaking up longer straights. Thus, a five-card straight would be played as a three-card straight and a two-card straight.

It is noted that in using conventional playing cards, an Ace may be the highest value playing card, the lowest value playing card, and/or may be used to connect a wrap-around straight. That is, in one optional embodiment, an Ace may only be used with a King to form a straight. In another optional embodiment, an Ace may only be used with a deuce to form a straight. In another optional embodiment, an Ace may be used with a King or a deuce to form a straight. In yet another optional embodiment, an Ace may be used with a King and a deuce to form a straight, e.g., a three-card wrap-around straight of King, Ace, 2. In an optional embodiment conducted using a device, a hand ranking system may be stored in a data storage device accessible to a data processor conducting the game and the determination of the hand ranking of the player hand and/or final player hand may be conducted by a data processor.

In another optional embodiment, sets may include flushes. In one such optional embodiment, for example, if a player hand includes two hearts, three clubs, one spade, and one diamond suited playing cards, the player hand would contain two flushes (a two-card flush and a three-card flush). Using a similar hand ranking system described above, a hand with three flushes would outrank a hand with two flushes which, in turn, would outrank a hand with one flush. Similarly, a hand with a four-card flush and a two-card flush would outrank a hand with two three-card flushes because of the larger flush (i.e., a four-card flush contains more playing cards than a three-card flush).

As noted above, in an optional embodiment, the playing cards that do not fit within a set may remain in the final player hand. In one optional embodiment, those unused playing cards may be disregarded in determining the ranking of the final player hand. In another optional embodiment, the playing cards not utilized within a set may be used to form a separate component hand within the final player hand. Thus, in one such optional embodiment, a final player hand may consist of two component hands: one component hand containing the highest ranking set of game pieces with complementary game indicia and a separate component hand containing the remaining game pieces to form a component hand ranked according to a defined hand ranking system including, for example, poker hand rankings, blackjack hand rankings, pai gow hand rankings, baccarat hand rankings, or the like. For example, if a final player hand includes playing cards with the values 3, 4, 4, 7, 8, Ace, Ace, one component hand includes two two-card straights (i.e., 3-4 and 7-8), while the other component hand includes the remaining three cards 4, Ace, and Ace, which may be evaluated as a pair of Aces in an optional embodiment for purposes of a side wager.

In yet another optional embodiment, playing cards not utilized in any set are removed from the player hand. Thus, a player hand may be dealt seven playing cards, but the final hand may include any quantity of playing cards, depending on how many sets are formed and the quantity of playing cards in each set. In the example above, a final player hand with two two-card straights would contain only four playing cards with the remaining three playing cards discarded or collected.

The final player hand is evaluated 112 to determine if the hand is a winning hand. As noted above, the hand ranking system may take any form. In one optional embodiment, hands are ranked first by the quantity of sets in a hand with complementary game indicia. In such an optional embodiment, a hand with, for example, three straights always outranks a hand of one or two straights, without examining the cards making up the hands. In an optional embodiment, separate areas may be provided for each set. A player hand with three sets would be arranged in the areas with one set in each area; a player hand with two sets would be arranged with sets occupying two of the three areas; a player hand with one set would be arranged with one of the areas occupied by the one set. In this manner, a determination may be made quickly of the quantity of sets contained within a player hand.

In an additional or alternative embodiment, hands are ranked second by the quantity of game pieces in the largest set, if the quantity of sets between two hands are equal. In such an optional embodiment, a hand which has a four-card straight and a two-card straight outranks a hand which has two three-card straights. In a further optional embodiment, the hand ranking system may look at the values of the game pieces in the sets to differentiate the hands. Thus, in one such example, a King-high four card straight may outrank an eight-high four-card straight.

In a further optional embodiment, a hand ranking system may additionally take account of whether values of the suited game pieces have some other relationship. For example, in one such optional embodiment, game pieces with matching suit may be accorded a higher ranking. Thus, in one such example, a three-card straight flush may outrank a three-card straight. In the examples given below, such a hand ranking is not used in resolving a base bet but may be used in resolving a bonus or side bet. However, it is noted that such a hand ranking may be used in resolving a base bet, a bonus or side bet, or any bet according to an embodiment of the present invention.

Each wager is resolved by evaluating the final player hand associated with the wager. In an optional embodiment conducted using a device, the evaluation of the final player hand(s) may be performed by a data processor.

Evaluation of final player hands may take many different forms. In one optional embodiment, a final player hand may be evaluated by comparing the final player hand to a pay table listing winning hands and associated pay outs. Specifically, in one optional embodiment a pay table is defined. The pay table includes hand rankings, such as a three straights, two straights, and so forth, and pay outs associated with final player hands associated with those hand rankings. When a final player hand matches a hand ranking on the pay table, the player's wager is rewarded based on the payout associated with the hand ranking. In an optional embodiment, the hand rankings may be broken down even further to provide additional payout levels. For example, a hand with a three-card straight and a two-card straight may be associated with a larger payout than a hand with two two-card straights.

In an additional or alternative optional embodiment, the final player hand may be compared to a final dealer hand. In one such optional embodiment, the final dealer hand may be formed by dealing a dealer hand and forming a final dealer hand from the dealer hand. In a further optional embodiment, as discussed above, it may be required that the final dealer hand meet 110 a qualifying hand ranking, i.e., the final dealer hand must "qualify," for the final player hand to be evaluated against the final dealer hand. In one optional embodiment in which the final dealer hand is formed from a dealer hand containing seven conventional playing cards, and sets are formed from consecutive value playing cards, i.e., straights, a final dealer hand may be required to have at least one Jack-high three-card straight to qualify. In alternate optional embodiments, examples of which are given below, other qualifying hand rankings may be utilized or no qualification may be required, i.e., the hand comparison step is always performed regardless of the rank of the final dealer hand. In an optional embodiment utilizing dealer qualification in which a player places an ante wager and a raise wager, the failure of the final dealer hand to qualify may lead to a pay out to the player on the ante wager and a return (or push) of the raise wager to the player.

In such an optional embodiment, the hand ranking of the final dealer hand may be compared to each final player hand using a defined hand ranking system and the wagers may be resolved 116 by determining whether to issue a reward based on the comparison. As discussed above, in one such example, a final player hand with three two-card straights may outrank a final dealer hand with a two-card straight and a three card straight which leads to a reward to the player based on the ante wager and any raise wager. Conversely, a final player hand with a three-card straight and a two-card straight may be outranked by a final dealer hand with two three-card straights and may result in a loss by the player of the ante wager and any raise wager.

In yet a further additional or alternative optional embodiment, a final player hand may be evaluated by comparing the final player hand to other final player hands. In one such optional embodiment, a pot may be formed from at least a portion of the wagers, e.g., the ante wagers or a portion thereof and/or the raise wagers or a portion thereof. The final player hands among all the players may be compared, and the pot may be awarded to the player with the highest ranking final player hand.

In yet a further additional or alternative optional embodiment, multiple different comparisons may be made in evaluating the final player hand. For example, separate wagers may be received for evaluation of a final player hand against a pay table, a final dealer hand, and/or final player hands of other players. In this manner, a single player hand could, at the player's election, be the subject of up to three wagers resolved in up to three different ways.

In one example utilizing playing cards marked with suit and rank indicia, an embodiment of a method includes receiving wagers from players and dealing a seven-card player hand to each player and a seven-card dealer hand. It is contemplated that each player hand can be constituted from cards dealt directly to a player or from a combination of n community cards and (7−n) individual cards, where n could be any quantity between 1 and 6. In another embodiment, player hands may be dealt in stages. For example, in one optional embodiment, each player could receive 1 to 6 cards initially, inspect the initial cards, place a raise bet, and receive the remaining cards to make a seven-card hand. It is noted that the quantity of cards in a player hand may vary in alternate optional embodiments and, consequently, a game conducted according to a method of the present invention could be conducted with any quantity of cards. Furthermore, as noted above, any game piece, or electronic representation thereof, may be used to conduct the method as the use of the terms "playing card" and "card" in this description is merely illustrative and should not be interpreted as limiting.

Each player forms a final hand to compare against a final dealer hand according to a hand ranking system. In an optional embodiment, the hand ranking system may rank hands according to the quantity of straights that can be formed from the hand and, when two hands have an equal number straights, the quantity of playing cards in the largest straight in the hand.

Continuing with the first example, that is, an embodiment in which hand are ranked first on the quantity of straights and second on the size of the longest straight, the first rule of the ranking system may be summarized as shown in Table 1.

TABLE 1

| Hand Rankings (in descending order) |
|---|
| 3 straights |
| 3-card straight + 2-card straight + 2-card straight<br>2-card straight + 2-card straight + 2-card straight<br>2 straights |
| 3-card straight + 3-card straight<br>3-card straight + 2-card straight<br>2-card straight + 2-card straight<br>1 straight |
| 3-card straight<br>2-card straight |

In comparing hands with an equal quantity of straights, and the length of the straights does not differentiate the hands, an additional ranking rule may be applied. The additional ranking rule examines the highest card of the straights in each hand in descending length and differentiates the hands based on the ranking of the highest card in the straights in descending length. For example, the highest ranking card in the longest straight in each hand may be compared. If the highest ranking card differentiates the hands, the hand with the higher or highest ranking card would be the higher ranking hand. If the highest ranking card in the hands is the same (e.g., two hands with a Jack-high four-card straight), the highest card in the next-longest straight is examined and a determination, if possible, is made based on the highest ranking card in the next longest straight. This continues until a straight differentiates the two hands and the hands can be ranked relative to one another or it is determined that the hands are "copy" hands, that is, the hands have exactly the same straights.

Thus, in one such example, a hand with a Jack-high four-card straight and a seven-high two-card straight outranks a hand with a Jack-high four-card straight and a five-high two-card straight. In an optional embodiment, conventional poker card order is used, e.g., in descending order, Ace, King, Queen, Jack, ten, nine, eight, seven, six, five, four, three, and deuce. In alternate optional embodiments, similar ranking systems may be created based on pictures, colors, or the like.

As noted above, in alternate optional embodiments, the hand ranking system could take other forms. In one such optional embodiment, a hand ranking system may be defined for a game in which sets are formed based on flushes, i.e., suited playing cards. For example, in one such embodiment, each final player hand is compared to the final dealer hand using a hand ranking system that the hand with the greater number of flushes wins and that when two hands have an equal number of flushes, the hand with larger flush (e.g., the flush containing more playing cards) wins. One example of such a hand ranking system is illustrated in Table 2.

TABLE 2

| Hand Rankings (in descending order) |
|---|
| 3 flushes |
| 3-card flush + 2-card flush + 2-card flush<br>2-card flush + 2-card flush + 2-card flush<br>2 flushes |
| 3-card flush + 3-card flush<br>3-card flush + 2-card flush<br>2-card flush + 2-card flush<br>1 flush |
| 3-card flush<br>2-card flush |

In yet another example, both straights and flushes may be formed. In one such optional embodiment, a player may be required to elect between straights or flushes for resolution of the player's ante wager and raise wager and form a hand consisting entirely of straights or flushes according to the player's election. In another optional embodiment, a player may form both straights and flushes, i.e., create a mixed hand of flushes and straights.

In the following example, a hand ranking system based on straights as described in Table 1 is utilized. In one such example, illustrated in FIG. 2, a game is conducted at a live or electronic gaming table, or using an electronic device, that includes a display of a player area 202 with an ante wager betting area 204, a raise wager betting area 206, and, optionally, wagering areas for side wagers 208, 210. The side wagers are described in greater detail below, but broadly speaking, the two side wagers illustrated in FIG. 2 must be separately wagered at the beginning of a game and result in a reward to the player if the final player hand is a hand listed on the side wager pay tables 212.

A game may be conducted using a conventional deck of fifty-two cards. Before the game starts, each player places the ante bet within the limits set by the house. Players also place side bets, which may be mandatory, optional, or mixed, with some optional and others mandatory.

In one embodiment, every player receives a player hand of seven cards, although it is contemplated that the game may be conducted with any quantity of cards. In a live embodiment, a dealer deals every player seven cards and himself seven cards. In an embodiment conducted using a device, a data processor deals a player hand of seven cards and a dealer hand of seven cards (which may remain unexposed until after the player hand is completed).

Every player inspects his or her player hand and, in this optional embodiment, forms as many sets of complementary cards as possible and discards any cards that do not fit into a set. Thus, in the example utilizing straights, the player hand consists of as many straights as can be formed, with any cards that do not fit into a straight being discarded. Similarly, in the example utilizing flushes, the player hand consists of as many flushes as can be formed, with any cards that do not fit into a flush being discarded.

In an optional embodiment, an election is received whether to "bet or fold," i.e., to: (a) place a raise wager and continue in the game or (b) fold and forfeit the ante wager. In an optional embodiment, side bets may not be forfeited and may remain in play if the election to fold is received. In one embodiment, an election to raise may be accompanied by an election to place a raise wager equal to 1×, 2×, or 3× the ante wager. In a further optional embodiment, the maximum amount of the raise wager may depend on the quantity of sets in the player hand. For example, in one such optional embodiment, if a player hand includes three sets (e.g., three straights or, alternatively, three flushes), the raise wager may be less than or equal to three times the ante wager (e.g., equal to the ante wager, double the ante wager, or triple the ante wager. Conversely, if the player hand includes two sets, the raise wager may be less than or equal to two times the ante wager (e.g., equal to the ante wager or double the ante wager). If the player has a single set, the raise wager may be equal to the ante wager.

As noted above, in an optional embodiment, the unused cards may be removed from the final player hand. In another optional embodiment, the unused cards remain in the final player hand. In one such optional embodiment, the unused cards may be segregated form the final player hand.

Where the unused cards are removed from the final player hand, the unused cards and any folded hands may be collected and discarded. In an optional embodiment in which final player hands are compared to a final dealer hand, a dealer hand may be revealed or displayed at a display. A final dealer hand is formed from the dealer hand in a similar manner to the formation of the final player hand(s). That is, a determination may be made of the greatest quantity of sets that can be formed from the cards of the dealer hand, with the cards not fitting within a set remaining unused or discarded from the dealer hand to form the final dealer hand.

As noted above, in one optional embodiment, no qualification is necessary to proceed to a comparison between the final dealer hand and the final player hand. In another optional embodiment, a final dealer hand may be required to qualify to proceed to a comparison to the final player hand. In one optional embodiment, the final dealer hand must have at least a three-card, Jack-high straight to qualify. In an optional embodiment, when a dealer's does not qualify, the wagers are resolved without comparison between the final player hand and the final dealer hand. In various optional embodiments, the ante wager could be rewarded and the raise wager may be returned, the ante wager may be returned and the raise wager rewarded, both wagers could be rewarded, or both wagers could be returned.

When the final dealer hand is a qualifying hand, or no qualification is required, the final dealer hand is compared to each final player hand according to a defined hand ranking system. In one such optional embodiment, a hand ranking system may include: (a) when the quantity of sets of complementary cards in the final player hand is greater than that of the final dealer hand, the player receives a payout of even money for his raise wager and ante wager; (b) when the quantity of sets of complementary cards in the final player hand equals that of the final dealer hand, the hand with the larger set; (c) when the final player hand and the final dealer hand copy, wagers are returned to the player; and (d) when the quantity of sets of complementary cards in the final player hand is less than that of the final dealer hand, the player's ante wager and raise wager are collected. In a further optional embodiment, if the final player hand contains a special holding (e.g., royal straight), a pre-determined bonus could be issued based on the ante wager and/or the raise wager.

Thus, in an example in which the sets are formed by consecutive value cards, i.e., straights, the hand with the greater quantity of straights wins and, if the hands contain the same quantity of straights, the hand with the longer straight wins. If the hands have the same quantity of straights and equal length straights, the ranking of the cards in each of the straights may be compared in descending length of the straights, e.g., compare the high cards of the longest straights, then the high cards of the second longest straights, and so forth, until the hands are differentiated. If the hands are identical, a push occurs.

In an optional embodiment, side wagers may be offered. In an optional embodiment, side wagers must be selected and placed before any cards are dealt. In one optional embodiment directed to straights, one or more side bets may be offered including, but not limited to, a straight side bet (rewarded based on the length of the longest straight in the final player hand); a multiple straights side bet (rewarded based on the quantity of straights and/or the makeup of the multiple straights in the final player hand); a loaded side bet (rewarded based on any player at the table obtaining a six or seven card straight); a dealer's hand side bet (rewarded based on predicting the constitution of the final dealer hand); a royal side bet (rewarded based on the final player hand containing four or more cards forming a royal straight, e.g., ten, Jack, Queen, King, and/or Ace); or the like.

Similarly, in one optional embodiment directed to flushes, one or more side bets may be offered including, but not limited to, a flush side bet (rewarded based on the size of the largest flush in the final player hand); a multiple flushes side bet (rewarded based on the quantity of flushes and/or the makeup of the multiple flushes in the final player hand); a loaded side bet (rewarded based on any player at the table obtaining a six or seven card flush); a dealer's hand side bet (rewarded based on predicting the constitution of the final dealer hand); or the like.

The side wagers are optionally resolved after the final player hands are formed. In an optional embodiment, the pay outs for side wagers are defined based on the amount wagered on the side wager. In one embodiment the straight side wager may be limited so that the amount wagered on the straight side wager is less than, or equal to, the ante wager. In the optional embodiment of FIG. 2, a straight side wager may be placed in a straight side wager area 208. In one optional embodiment, a payout for the straight side wager is determined by comparing the longest straight in the final player hand to a pay table. Table 3 illustrates an example pay table for a straight side wager.

TABLE 3

| Player's Hand | Payout |
|---|---|
| 7 card straight | 200 to 1 |
| 6 card straight | 50 to 1 |
| 5 card straight | 5 to 1 |
| 4 card straight | 1 to 1 |
| 2 or 3 card straight | Lose |
| 0 straights | 3 to 1 |

In an optional embodiment, a loaded side bet may be offered. In one such optional embodiment, a reward is issued when any player on the table, excluding the dealer, gets seven-card or six-card flush. In an optional embodiment, each player who placed a loaded side bet is rewarded, i.e., a player becomes eligible to receive an award when any player at the table obtains a six or seven-card flush, by placing a loaded side bet. Table 4 illustrates an example pay table for a loaded side bet.

TABLE 4

| Hand | Payout |
|---|---|
| 7-card straight | 1000 to each eligible player |
| 6-card straight | 50 to each eligible player |
| Others | Lose |

A multiple straights side bet may be rewarded based on a player obtaining a multiple straights. In the optional embodiment of FIG. 2, a multiple straights side wager may be placed in a multiple straights side wager area 210. In one optional embodiment, a payout for the multiple straights side wager is determined by comparing the quantity of straights in the final player hand to a pay table. Table 5 illustrates an example pay table for a multiple straights side bet.

TABLE 5

| Hand | Payout |
|---|---|
| 3 straights | 7 to 1 |
| 2 straights | 3 to 1 |

In a further optional embodiment, a multiple straights side bet could be further expanded to the specific make-up of the multiple straights and/or the cards constituting the straights. For example, Table 6 illustrates a multiple straights pay table that is expanded to include the makeup of the straights while Table 7 illustrates a multiple straights pay table that is expanded to include the cards constituting the straights.

TABLE 6

| Hand | Payout |
|---|---|
| 5 card straight + 2 card straight | 50 to 1 |
| 4 card straight + 3 card straight | |
| 3 card straight + 3 card straight + 2 card straight | |

TABLE 6-continued

| Hand | Payout |
|---|---|
| 4 card straight + 2 card straight | 10 to 1 |
| 3 card straight + 3 card straight | |
| 2 card straight + 2 card straight + 2 card straight | |
| 3 card straight + 2 card straight | 5 to 1 |
| 2 card straight + 2 card straight | Push |

TABLE 7

| Hand | Payout |
|---|---|
| 7 card Ace-high straight | 2000 to 1 |
| 5 card Royal straight + 2 card Ace-high straight | 1000 to 1 |
| 5 card straight + 2 card straight | 50 to 1 |
| 4 card straight + 3 card straight | |
| 3 card straight + 3 card straight + 2 card straight | |
| 4 card straight + 2 card straight | 10 to 1 |
| 3 card straight + 3 card straight | |
| 2 card straight + 2 card straight + 2 card straight | |
| 3 card straight + 2 card straight | 5 to 1 |
| 2 card straight + 2 card straight | Push |

It is noted that a royal straight side bet could be offered in addition to, or in place of, a multiple straight side bet. It is further noted that any of the rewards offered for side bets could be progressive jackpots that are funded by, for example, an allocation for the wager. The progressive jackpot accrues until the progressive jackpot is awarded, at which time the progressive jackpot is reset to a starting value and begins to accrue again.

Figure 3:
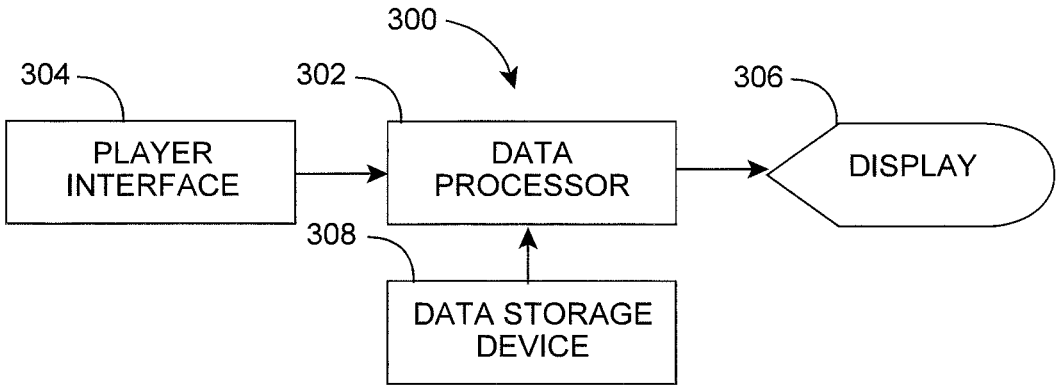
FIG. 3 is a block diagram of a device according to an embodiment of the present invention.

As discussed above and illustrated in FIG. 3, the present method could be implemented on a device 300, such as a cellular telephone, computer network (including, for example, the Internet), personal computer, electronic gaming machine, video card game machine, kiosk, handheld device, tablet, or any other type of device. In an optional embodiment, the device includes a data processor 302 in communication with a data storage device 308 that stores executable program instructions for conducting a method. The data processor 302 also communicates with a display 306 and a player interface 304. In an optional embodiment, the display 306 and player interface 304 may be integrated into a single device such as a touchscreen.

In one such optional embodiment, an ante wager may be placed through a player interface 304. A data processor 302 deals a player hand of game pieces (such as electronic representations of cards) and displays the player hand at the display 306. Optionally, the player may be permitted or required to place a raise wager, although this raise wager may be omitted in certain optional embodiments.

In one optional embodiment, the data processor 302 selects the final player hand for the player by selecting the greatest quantity of sets of game pieces with complementary indicia from the player hand. In another optional embodiment, the player inputs a selection of a final player hand through the player interface 304. The data processor 302 evaluates the final player hand (optionally by comparing the final player hand to a final dealer hand, a pay table, final player hands of other players, or the like) and determines whether to issue rewards on the player's wager(s). Optionally, side wagers may be offered and resolved by the data processor 302 if received through the player interface.

One example of a device 300 is a gaming machine. Such a gaming machine may have various configurations. The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 4:
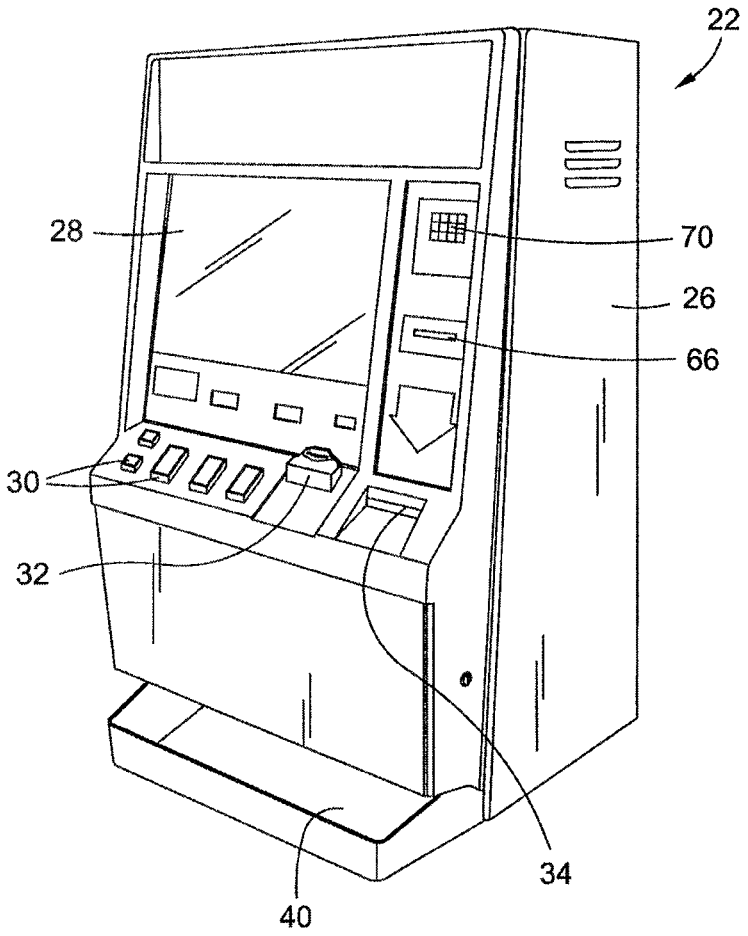
FIG. 4 is a gaming machine that is a device according to an embodiment of the present invention.

One configuration of a gaming machine 22 is illustrated in FIG. 4. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 22 might include more than one display device 28, such as two or more displays 28 which are associated with the housing 26.

The gaming machine 22 might also include a top box or other portion. Such a top box might include one or more display devices 28, such as in addition to one or more main displays which are associated with the housing 26. Also, the gaming machine 22 might include side displays (such as mounted to the exterior of the housing 26) and might include multiple displays of differing sizes. The gaming machine 22 might also include other types of game information display devices, such as one or more spinning mechanical reels, wheels or the like.

The gaming machine 22 is preferably configured to present one or more games upon a player making a monetary payment or wager, as described above. In this regard, the gaming machine 22 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. The gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to indicate cards to be held or discarded, to "cash out" of the gaming machine, or to provide various other inputs.

In one preferred embodiment, the gaming machine 22 includes at least one microprocessor or controller for controlling the gaming machine, including receiving player input and sending output signals for controlling the various components of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28 and for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 22 may also include one or more random number generators for generating random numbers, such as for use in selecting cards and for presenting the game in a random fashion.

Preferably, the controller is configured to execute machine readable code or instructions which are configured to implement the method of game play of the invention. For example, the controller of the gaming machine 22 may be configured to detect a wager, such as a signal from a player's depressing of the "bet one" button. Upon such an event and/or the player otherwise signaling the gaming machine to present the game, the controller may be configured to cause game symbols or other game information to be displayed on the at least one display 28. The controller may accept input from a player of game inputs, such as a request to spin reels or the like, via the one or more player input devices of the gaming machine 22.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 22 may also include a player tracking device, such as a card reader 66 and associated keypad 70. Such player tracking devices are well known and may permit the game operator to track play of players of the gaming machine. The tracked play may be utilized to offer player bonuses or awards.

It will be appreciated that the gaming machine illustrated in FIG. 4 is only exemplary of one embodiment of a gaming machine. For example, it is possible to for the gaming machine to have various other configurations, including different shapes and styles and having different components than as just described.

For example, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays.

A casino may have numerous such gaming machines 22, such as located on a casino floor or in other locations. Of course, such gaming machines 22 might be used in other environments, such as an airport, a bar or tavern or other locations.

Figure 2:
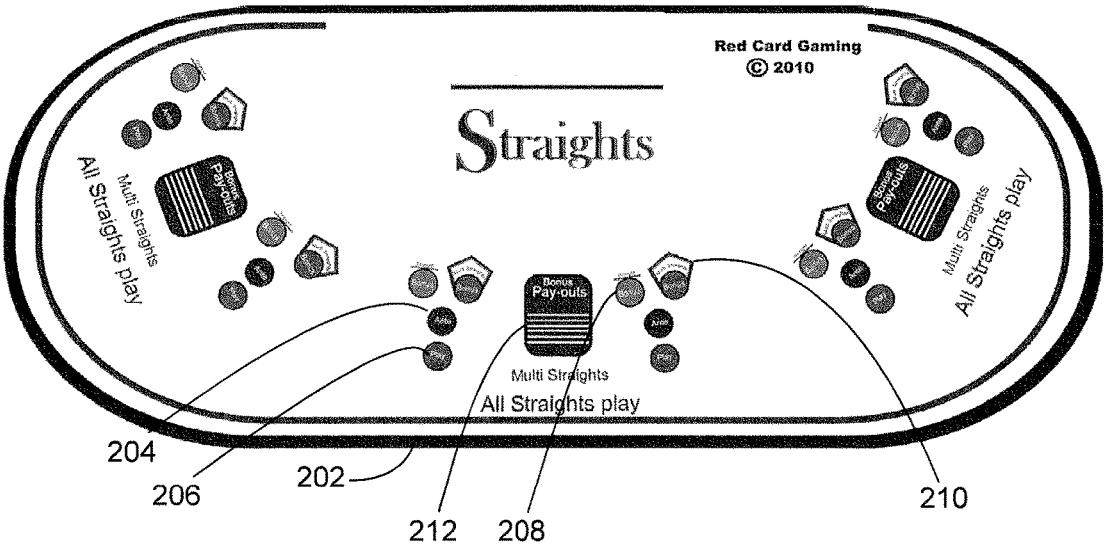
FIG. 2 is a top view of a table layout according to an embodiment of the present invention.

The gaming device 300 might comprise or include one or more game tables. The game table may define one or more play surfaces for chips, playing cards or the like, such as illustrated in FIG. 2. The game table might include one or more card shuffling devices or other equipment. In other embodiments, the game table might include one or more electronic video displays or the like, such as for displaying game piece information. The game table might also include wager accepting devices (such as ticket readers, coin acceptors, currency readers, credit card readers or the like) and player input devices (such as wager buttons, touch screens or the like).

The present method may also include side wagers based on multiple sets within a hand of game pieces. For example, in an optional embodiment, a pai gow poker side wager may be offered which is determined based on multiple sets of complementary game pieces being formed from the player hand, dealer hand, or both hands.

In one such example directed to pai gow poker, a seven-card player hand may be dealt to each player and a seven-card dealer hand may be dealt. In one such optional embodiment, a side wager on the dealer hand may be offered in which the dealer hand is set according to a "house-way" into a two-card front hand and a five-card back hand. A pay table may be defined with payouts for a set of complementary game pieces formed in one or both of the front hand and back hand of the dealer hand. For example, a pay table such as that illustrated in Table 8 may be offered.

TABLE 8

| Dealer Hand | | |
|---|---|---|
| Front Hand | Back Hand | Payout |
| Five-Card Straight | Two-Card Straight (connecting) | 100 to 1 |
| Five-Card Flush | Two-Card Flush (matching) | 100 to 1 |
| Five-Card Straight | Two-Card Straight (not connecting) | 50 to 1 |
| Five-Card Flush | Two-Card Flush (not matching) | 50 to 1 |
| Five-Card Straight or Flush | | 10 to 1 |
| Four-Card Straight or Flush | | 5 to 1 |
| Three-Card Straight of Flush | | 1 to 1 |

As may be appreciated, in an optional embodiment, a pay table may additionally or alternatively be defined with the side wager resolved based on a front hand and/or back hand of the player hand (rather than, or in addition to, the dealer hand) that contains a straight or flush. That is, in one such optional embodiment, the player hand may be set, then the front hand and back hand of the player hand may be examined for flushes or straights. If a player hand contains at least a three-card straight or flush in the back hand, a payout is issued. A greater payout may be issued if the back hand contains at least a three-card straight or flush and the front hand includes a two-card straight or flush.

In another example of a pai gow poker side wager, a side wager may be resolved based on a straight or flush in only one of the component hands of the player hand and/or dealer hand. That is, in one such optional embodiment, only the two-card hand (or alternatively, the five-card hand) may be examined for a straight or a flush, with payouts being defined on a pay table for a straight or flush in the corresponding component hand.

In yet another example of a pai gow poker side wager, a side wager may be resolved based on the sum of two playing cards. For example, the sum of the playing cards in the front hand of the player hand (and/or dealer hand) may be determined and compared to a pay table which lists all possible two-card sums and whether the sum results in a payout, a push, or a loss of the side wager.

While certain embodiments of the present invention have been shown and described it is to be understood that the present invention is subject to many modifications and changes without departing from the spirit and scope of the invention presented herein.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of conducting a wagering game for at least one player using a device having a data processor in communication with a display, a player interface, and a data storage device, said data storage device adapted to store game pieces marked with at least one game indicium, said game indicia defined such that the game pieces may be included in sets of complementary game indicia, said data processor adapted to execute program instructions to conduct a method comprising the steps of:

receiving an ante wager from each player through said player interface; dealing a player hand of game pieces by said data processor;

receiving an election through said player interface to fold and surrender the player's ante wager or place a raise wager, wherein the maximum amount of said raise wager varies depending on the quantity of sets of complementary game pieces that can be formed from the game pieces of the player hand;

for each player electing to place a raise wager, forming a final player hand from each player hand by forming as many sets as possible of complementary game pieces in said player hand marked with complementary game indicia;

evaluating each final player hand by said data processor based at least on the quantity of sets of complementary game pieces in said final player hand; and determining whether to issue a pay out by said data processor based on the evaluation of each final player hand.

2. The method of claim 1 wherein said game pieces are playing cards, said game indicia are values, and said sets include game indicia with consecutive values.

3. The method of claim 1 further comprising:

dealing a dealer hand of game pieces by said data processor; and forming a final dealer hand by said data processor by forming as many sets as possible of complementary game pieces from the game pieces in said dealer hand such that said step of evaluating comprises comparing the quantity of sets in each final player hand to the quantity of sets in said final dealer hand and said step of determining comprises issuing a payout for each final player hand that outranks said final dealer hand and collecting at least said ante wager for each final player hand outranked by said final dealer hand.

4. The method of claim 1 further comprising:

storing at said data storage device a pay table of hand rankings associated with pay outs, such that said step of evaluating said final player hand comprises said data processor comparing said final player hand to said pay table and said step of determining comprises said data processor issuing the pay out, if any, associated with the hand ranking of said final player hand according to said pay table.

5. The method of claim 1 conducted for a plurality of players wherein said step of evaluating said final player hand comprises said data processor comparing said final player hands of said plurality of players and said step of determining comprises said data processor issuing a pay out to the player having the highest ranking player hand.

6. The method of claim 1 further comprising dealing a community hand including at least one game piece such that said step of forming comprises forming a final player hand from among said player hand and said community hand.

7. The method of claim 1 further comprising discarding game pieces from said player hand not included in any set of complementary game pieces.

8. A method of conducting a wagering game for at least one player using a device having a data processor in communication with a display, a player interface, and a data storage device, said data storage device adapted to store playing cards marked with at least a value, said data processor adapted to execute program instructions to conduct a method comprising the steps of:

receiving an ante wager from each player through said player interface; dealing by said data processor a player hand of playing cards;

receiving an election through said player interface to fold and surrender the player's ante wager or place a raise wager, wherein the maximum amount of said raise wager varies depending the quantity of sets in said player hand, wherein each set contains playing cards of consecutive value;

for each player electing to place a raise wager, forming a final player hand from each player hand by forming as many sets as possible from the playing cards in said player hand, wherein each set contains playing cards of consecutive value;

evaluating said final player hand by said data processor based at least on the quantity of sets in said final player hand; and determining whether to issue a pay out by said data processor based on the evaluation of each final player hand.

9. The method of claim 8 further comprising: dealing a dealer hand; and forming a final dealer hand by forming as many sets as possible from the playing cards in said dealer hand, wherein each set contains playing cards of consecutive value, such that said step of evaluating comprises comparing each the quantity of sets in said final player hand to the quantity of sets in said final dealer hand and said step of determining comprises issuing a payout for each final player hand that outranks said final dealer hand and collecting at least said ante wager for each final player hand outranked by said final dealer hand.

10. The method of claim 8 further comprising:

defining a pay table of hand rankings associated with pay outs, such that said step of evaluating said final player hand comprises comparing said final player hand to said pay table and said step of determining comprises issuing the pay out, if any, associated with the hand ranking of said final player hand according to said pay table.

11. The method of claim 8 further comprising:

defining a side wager pay table of hand rankings and associated pay outs; receiving a side wager from at least one player prior to dealing said player hand; and resolving said side wager by comparing said final player hand to said side wager pay table and issuing the pay out, if any, associated with said final player hand.

* * * * *